US006019429A

United States Patent [19]

Tedesco

[11] Patent Number: 6,019,429

[45] **Date of Patent: *Feb. 1, 2000**

[54] CONTROL MECHANISM FOR A CHAIR

[75] Inventor: Romeo Tedesco, Weston, Canada

[73] Assignee: Global Upholstery Company, Downview, Canada

[ * ] Notice: This patent is subject to a terminal disclaimer.

[21] Appl. No.: 09/265,831

[22] Filed: Mar. 10, 1999

Related U.S. Application Data

[63] Continuation of application No. 08/849,742, Jun. 30, 1997, Pat. No. 5,899,530.

[51] Int. Cl.[7] ..... A47C 1/02

[52] U.S. Cl. ..... 297/328; 297/326; 297/463.1

[58] Field of Search ..... 297/325–328, 297/344.12, 344.18, 344.19, 463.1, 313; 74/110

[56] References Cited

U.S. PATENT DOCUMENTS

| | | | |
|---|---|---|---|
| Re. 34,381 | 9/1993 | Barnes | 24/590 |
| 2,579,305 | 12/1951 | Cushman | 115/116 |
| 2,653,648 | 9/1953 | Marshall | 155/25 |
| 2,863,494 | 12/1958 | Lautier et al. | 155/112 |
| 3,145,052 | 8/1964 | Morgan | 297/354 |
| 3,223,072 | 12/1965 | Bross | 120/42.03 |
| 3,284,135 | 11/1966 | Hiramatsu | 297/361 |
| 3,368,845 | 2/1968 | Watanabe | 297/330 |
| 3,578,379 | 5/1971 | Taylor et al. | 297/71 |
| 3,730,019 | 5/1973 | Ballard | 74/502 |
| 3,889,998 | 6/1975 | Weiland | 297/217 |
| 4,072,288 | 2/1978 | Wirges et al. | 248/404 |
| 4,076,308 | 2/1978 | Slabon et al. | 297/313 |
| 4,328,943 | 5/1982 | Eldon, III | 248/578 |
| 4,353,594 | 10/1982 | Lowe | 297/307 |
| 4,354,398 | 10/1982 | Porter | 74/501 X |
| 4,370,001 | 1/1983 | Örnberg | 297/355 |
| 4,373,692 | 2/1983 | Knoblauch et al. | 248/162.1 |
| 4,383,714 | 5/1983 | Ishida | 297/325 |
| 4,408,800 | 10/1983 | Knapp | 297/285 |
| 4,456,298 | 6/1984 | Gottstein | 297/353 |
| 4,595,237 | 6/1986 | Nelsen | 297/347 |
| 4,681,369 | 7/1987 | Simpson | 297/316 |
| 4,684,173 | 8/1987 | Locher | 297/300 |
| 4,720,143 | 1/1988 | Schwartz et al. | 297/326 |
| 4,743,065 | 5/1988 | Meiller et al. | 297/300 |
| 4,778,216 | 10/1988 | Stupakis | 297/17 |
| 4,787,673 | 11/1988 | Locher | 297/301 |
| 4,838,510 | 6/1989 | Holstensson | 248/397 |
| 4,916,968 | 4/1990 | Kabaya | 74/519 |
| 4,956,755 | 9/1990 | Maglica et al. | 362/206 |
| 5,024,484 | 6/1991 | Buchacz | 297/300 |
| 5,029,822 | 7/1991 | Selzer | 267/64.12 |
| 5,069,496 | 12/1991 | Kunh et al. | 297/300 |
| 5,090,770 | 2/1992 | Heinrichs et al. | 297/347 |
| 5,137,330 | 8/1992 | Lie et al. | 297/329 |
| 5,222,783 | 6/1993 | Lai | 297/306 |
| 5,456,448 | 10/1995 | Chou | 251/230 |

FOREIGN PATENT DOCUMENTS

| | | | |
|---|---|---|---|
| 052 832 | 6/1982 | European Pat. Off. | A47C 1/024 |
| 208 127 | 1/1987 | European Pat. Off. | A47C 1/024 |
| 250 207 | 12/1987 | European Pat. Off. | A47C 1/032 |
| 329 455 | 8/1989 | European Pat. Off. | A47C 1/024 |
| 41 14 101 | 5/1992 | Germany | A47C 3/30 |
| 405024467 | 2/1993 | Japan | B60N 2/22 |
| 6277126 | 10/1994 | Japan | A47C 1/024 |
| 7907059 | 4/1980 | Netherlands | A47C 1/022 |

*Primary Examiner*—Peter R. Brown
*Attorney, Agent, or Firm*—Philip Mendes da Costa; Bereskin & Parr

[57] ABSTRACT

A seating unit comprises a support member; a seat member pivotally mounted on the support member; an arm rest member having an actuating button positioned in the arm rest member, the button being movable between a first position and a second position; a fluid pressure cylinder having actuating means and operatively connected to the seat member for adjustment of the inclination thereof; and, a flexible cable having a first end connected to the button and a second end operatively connected to the actuating member. When the button is moved from the first position to the second position, the actuation member is actuated so that the inclination of the back member or the seat member may be adjusted and when the button is moved from the second position to the first position, the inclination of the back member or the seat member is fixed.

26 Claims, 10 Drawing Sheets

FIG. 7a.
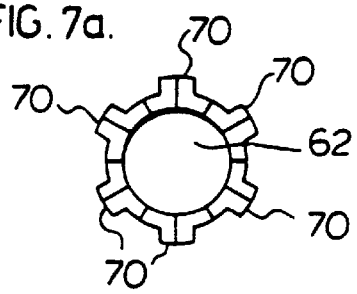
FIG. 8a.
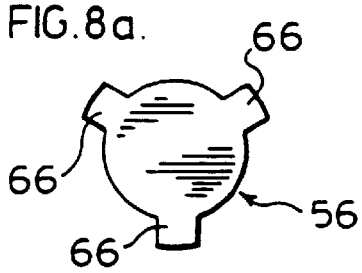
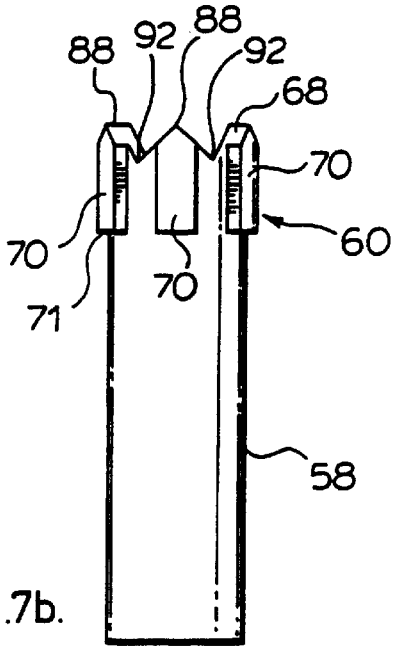
FIG. 7b.
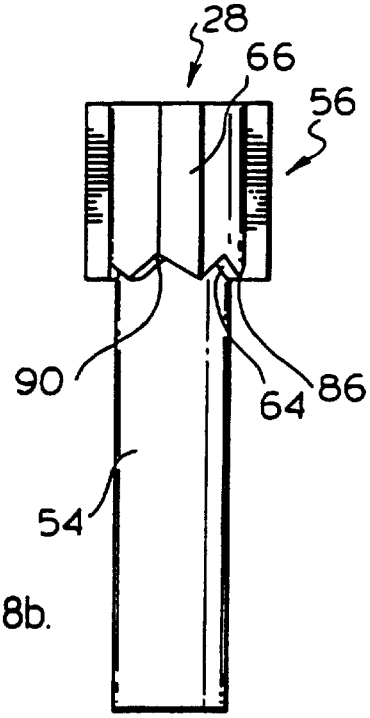
FIG. 8b.
FIG. 9a.
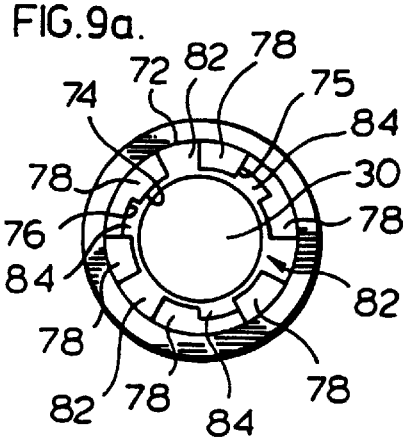
FIG. 9b.
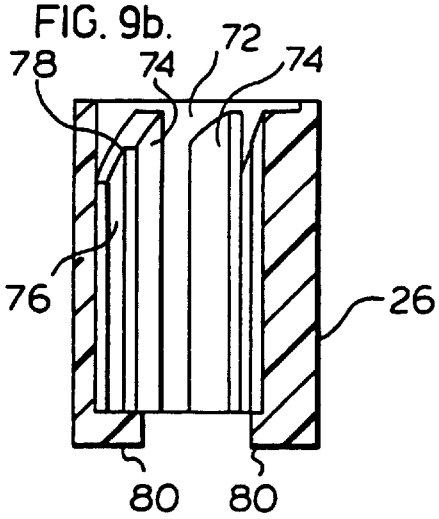

114
110
120
334
230
124
136
322
268
132
112
264
262
138
270
214
154
122
136
140
E
272
150
134
196
138
A
194
192
130
196
138
132
152
118
116

CONTROL MECHANISM FOR A CHAIR

This application is a continuation of U.S. patent application Ser. No. 08/849,742, filed Jun. 30, 1997, now U.S. Pat. No. 5,899,530, issued May 4, 1999.

FIELD OF THE INVENTION

This invention relates to a control mechanism for a seating unit. In one embodiment, this invention relates to an actuating mechanism including a button which may be positioned in the arm of a chair, such as a pedestal-type office chair, for adjusting the inclination from the horizontal of the seat member of the chair. In another embodiment, this invention relates to an actuating mechanism including a button which may be positioned in the arm of a chair, such as a pedestal-type office chair, for adjusting the inclination of the chair back member. In another embodiment, the button is movable between a first position and a second position and may be retained in both the first position and the second position.

BACKGROUND OF THE INVENTION

Many chairs which are used in a commercial environment, such as office chairs, chairs for computer data entry operators and chairs for operators of industrial plant process control equipment, are adjustable so that the chair will provide comfortable support to the user for an extended period of time. Accordingly, such chairs typically have a mechanism for adjusting the height of the chair. In addition, the chairs may include a mechanism for permitting the back support member of the chair to tilt relative to the seat member. Further, the chairs may provide a mechanism to permit the seat member of the chair to tilt so that the chair may be rocked backwards and/or forwards.

Typically, office chairs comprise a wheeled base, the seat member of the chair (which may include a back rest member) and a support leg extending between the wheeled base and the seat member. The height adjustment mechanism may employ a telescoping pneumatic cylinder which forms a part of, or may consist of, the support leg. These cylinders have a valve release pin provided thereon. The cylinder is generally in a locked condition but, when the valve release pin is depressed, the cylinder is unlocked typically permitting it to telescopically extend upwardly due to the force exerted by the pressurized fluid in the cylinder or contract downwardly due to, for example, a user sitting in the chair.

One mechanism which has been utilized to provide a tilt mechanism for the seat member of a chair comprises mounting the seat member on the support leg. A spring is provided so as to bias the seat member to the horizontal position. When the user leans backwardly in the chair, the users exerts a force greater than the biasing force of the spring thus causing the seat member to tilt rearwardly. An arm member positioned under the seat member may be used to lock the chair into the at rest, horizontal position. One disadvantage with this design is that the chair may not be fixed in an inclined position. Accordingly, if the user wishes to maintain the chair in an inclined position, they must continuously exert pressure against the spring.

Buchacz (U.S. Pat. No. 5,024,484) discloses an adjustable sitting device. The seat and/or back rest member of this device are turnable about an axis that is essentially coincident with an imaginary axis through the hip joints of the user. Slide members are provided so that the seat and back rest members of the chair are mounted for slidable movement with respect to each other. Movement of these members is controlled by locking means which interacts with the slide members and a gas cylinder.

Ishida (U.S. Pat. No. 4,383,714) discloses a rocking movable chair. The chair has a leg portion on which is mounted a circular arc surface. The seat member is mounted for travel along the circular arc surface. A spring is provided to bias the seat member in one direction during the rocking movement. A locking device utilizing a gas cylinder is provided to lock the rocking movement at a desired position.

Meiller et al (U.S. Pat. No. 4,743,065) discloses an office chair, the back rest member of which and the seat member of which may be adjusted by means of gas spring unit. Meiller et al discloses a locking member which utilizes a single actuating lever to adjust the inclination of the back rest member as well as the seat member.

Various control linkages for height adjustment mechanisms are known in the art. Examples of these include Kuhn et al (U.S. Pat. No. 5,069,496), Knapp (U.S. Pat. No. 4,408,800), Slabon et al (U.S. Pat. No. 4,076,308), Wirges et al (U.S. Pat. No. 4,072,288), Knoblauch et al (U.S. Pat. No. 4,373,692) and Lai (U.S. Pat. No. 5,222,783).

Numerous means have been used to control the inclination of the chair back member. These include various biasing means as well as the use of pneumatic cylinders. See for example Meiller et al (U.S. Pat. No. 4,743,065), Lei et al (U.S. Pat. No. 5,137,330), Kuhn et al (U.S. Pat. No. 5,069,496), Knapp (U.S. Pat. No. 4,408,800), Simpson (U.S. Pat. No. 4,681,369), Lai (U.S. Pat. No. 5,222,783), Slabon et al (U.S. Pat. No. 4,076,308) and Hiramatsu (U.S. Pat. No. 3,284,135).

Generally with the foregoing devices, the locking devices are adjusted by a lever or other mechanism which is positioned beneath the seat of the chair. Accordingly, the user must extend their arm downwardly and then transversely to a position underneath the seat to grasp the lever so that they can actuate the mechanism. This operation tends to be difficult particularly if the chair has a large, bulky arm. Since the use of these devices typically includes a biasing means to bias a chair to a preset position, the operator must move the actuating lever to the actuating position and hold the lever in that position while sitting in the chair so as to set the chair in the desired position. As this may require the operator to bend or stoop over, it is difficult to set the inclination of the chair accurately. This is also problematic if the operator has a back problem which prevents such movement.

Nelson (U.S. Pat. No. 4,595,237) discloses an actuating control for a seat height adjustment mechanism. The mechanism of Nelson uses a pivotally mounted lever positioned on the bottom of the seat number. Nelson still requires users to extend their arm downwardly beneath the seat to actuate the lever.

European Patent Application No. 0 329 455 discloses a device for adjusting and locking the inclination of a back rest of a, for example, air craft seat. The apparatus comprises a gas compression spring which is actuated by a button.

German Application DE-A-4 114 101 discloses a release device for a chair. The release device utilizes a longitudinally extending handle which is mounted beneath the seat of a chair and which projects outwardly therefrom. The handle actuates a Bowden cable which in turn actuates a pneumatic spring for a chair.

SUMMARY OF THE PRESENT INVENTION

In accordance with one embodiment of the instant invention, there is provided an actuator apparatus for actuating a positioning linkage including cylinder means in a seating unit receiving the actuator apparatus. The actuator apparatus comprises a housing adapted for mounting in the arm of a seating unit; button means receivable in the housing and moveable longitudinally between a first position and a second position, the button means including locking means for alternately maintaining the button means in the first and second positions; actuating means for moveable portion; flexible cable means having a first end connected to the button means and a second end operatively connected to the actuating means, whereby, when the button means is moved from the first position to the second position, the actuating means is actuated so that the moveable portion of the cylinder means may be adjusted relative to the stationary portion, and when the button means is moved from the second position to the first position, the moveable portion of the cylinder means is fixed relative to the stationary portion.

The cylinder means is preferably a non-pressurized cylinder (i.e. the fluid in the cylinder is not at an elevated pressure). The button means may comprise a longitudinally extending shaft member and the locking means may comprise first engagement means positioned on the shaft and second engagement means provided in the housing for engaging the first engagement means. Preferably, the housing has a longitudinally extending opening having an inner surface and the second engagement means is provided on the inner surface whereby movement of the button from the first position to the second position causes the first engagement means to undergo a rotational movement to alternately secure the button in the first and second positions.

In one embodiment, the seating unit comprises a support member; a seat member pivotally mounted on the support member; an arm rest member, the arm rest member including a housing; button means receivable in the housing and moveable longitudinally between a first position and a second position, the button means including locking means for alternately maintaining the button means in the first and second positions; a cylinder having actuating means and operatively connected to the seat member for adjustment of the inclination thereof; and, flexible cable means having a first end connected to the button means and a second end operatively connected to the actuating means whereby, when the button means is moved from the first position to the second position, the actuating means is actuated so that the inclination of the seat member may be adjusted and when the button means is moved from the second position to the first position, the inclination of the seat member is fixed.

In another embodiment a seating unit comprises a support member; a seat member pivotally mounted on the support member; an arm rest member, the arm rest member including a housing; a cylinder having actuating means and operatively connected to the seat member for adjustment of the inclination thereof, the cylinder having a telescopically extendable section, a stationary section and a valve release member moveable between a closed position in which the telescopically extendable section is fixed in position relative to the stationary section and an open position in which the telescopically extendable section is moveable relative to the stationary section, one of the telescopically extendable section and the stationary section is pivotally mounted on the support member and the other of the telescopically extendable section and the stationary section is pivotally mounted on the seat member, the cylinder extending upwardly from the support member to the seat member; actuating means operatively connected to the valve release member and movable between a first position, in which the valve release member is in the closed position, and a second position, in which the valve release member is in the open position; button means receivable in the housing and moveable longitudinally between a first position and a second position; and, flexible cable means having a first end connected to the button means and a second end operatively connected to the actuating means, whereby, when the button means is moved from the first position to the second position, the valve release member is moved to the open position so that the inclination of the seat member may be adjusted and when the button means is moved from the second position to the first position, the valve release member is moved to the closed position so that the inclination of the seat member is fixed.

In another embodiment a seating unit comprises a support member; a longitudinally extending seat member positioned on the support member; a back member pivotally mounted with respect to the seat member for movement between an upright position and a reclined position; an arm rest member, the arm rest member including a housing; button means receivable in the housing and moveable longitudinally between a first position and a second position, the button means including locking means for alternately maintaining the button means in the first and second positions; a cylinder having actuating means and operatively connected to the back member for adjustment of the inclination thereof; and, flexible cable means having a first end connected to the button means and a second end operatively connected to the actuating means, whereby, when the button means is moved from the first position to the second position, the actuating means is actuated so that the inclination of the back member may be adjusted and when the button means is moved from the second position to the first position, the inclination of the back member is fixed.

In another embodiment a seating unit comprises a support member; a longitudinally extending seat member positioned on the support member; a back member pivotally mounted with respect to the seat member for movement between an upright position and a reclined position; an arm rest member, the arm rest member including a housing; button means receivable in the housing and moveable longitudinally between a first position and a second position; locking means for alternately maintaining the button means in the first and second positions; a cylinder having actuating means and operatively connected to the back member for adjustment of the inclination thereof; and, flexible cable means having a first end connected to the button means and a second end operatively connected to the actuating means, whereby, when the button means is moved from the first position to the second position, the actuating means is actuated so that the inclination of the back member may be adjusted and when the button means is moved from the second position to the first position, the inclination of the back member is fixed.

In the embodiment for adjusting the inclination of the seat member, one of the telescopically extendable section and the stationary section is preferably pivotally mounted on the support member and the other of the telescopically extendible section and the stationary section is preferably pivotally mounted on the seat member. Further, the cylinder preferably extends upwardly from the support member to the seat member.

Preferably, the button means is positioned in a housing means and the button means travels inwardly into the housing means as the button means passes between the first and second positions (so as to undergo a inward translational movement). Further, it is also preferred that the force which is required to move the button means from the first position to the second position is from about 5 to about 10 pounds and, more preferably, the force is about 8 pounds. The distance which the button travels inwardly may be up to ⅝ inch and, more preferably, the distance is about ¼ inch.

Further, the actuating means may comprise an arm member pivotally mounted with respect to the valve release member, the arm member having a moment arm of sufficient length to permit the button means to move from the first position to the second position by the force applied through the finger of a user when the user is seated in the chair. The cylinder is a fluid filled cylinder. The fluid may be a gas (in which case the cylinder is a pneumatic cylinder which is also known in the industry as a gas damper). More preferably, the fluid is a non-compressible fluid such as oil. Preferably, the cylinder is a non-pressurized cylinder (i.e. the pressure of the fluid in the cylinder is sufficiently low so that the piston of the cylinder will not move without an external force applied thereto when the valve of the cylinder is opened).

In a further embodiment, the button means may include the locking means for alternately maintaining button means in the first position and then in the second position. Accordingly, when the button means is in the first position, the valve release member is in the closed position and accordingly the inclination of the chair is fixed. When the button is in the second position, the valve release member is open and the user may rock backwards and forwards in the chair continuously adjusting the inclination of the seat member or the inclination of the back rest member. The locking means comprises a member which forms part of the apparatus for actuating the positioning linkage and is therefore actuated by movement of the button. Preferably, the locking means forms part of the button means.

One advantage of the present invention is that the infinite tilt adjustment mechanism of the chair may be easily operated by the user. In particular, the button is conveniently located for the user so that the inclination of the seat member and/or the chair back member may be easily set by the user while seated in their normal work position. Thus, the operator may easily utilize their legs to tilt the seat member backwards while comfortably seated in the chair. A further advantage is that the user may operate the tilt mechanism by applying only a minimal pressure with one finger of their hand. Further, the tilt mechanism may be locked in any desired position, as opposed to preset positions. Accordingly, the user may adjust the inclination of the seat member of the chair to precisely match their needs.

A further advantage is that the user may operate the chair while in a regular seated position. As will be appreciated, a person whose back permits them to have only limited movement may be able to easily set the chair back to the desired inclination.

BRIEF DESCRIPTION OF THE DRAWING FIGURES

These and other advantages of the instant invention will be more fully and completely understood by reference to the following drawings of a preferred embodiment of the invention in which:

FIGS. 1*a* and 1*b* are schematic representations of a use of the two position button according to the instant invention;

FIG. 1*c* is a cross section along the line 1—1 in FIG. 1*b* of an alternate actuator;

Figure 6:
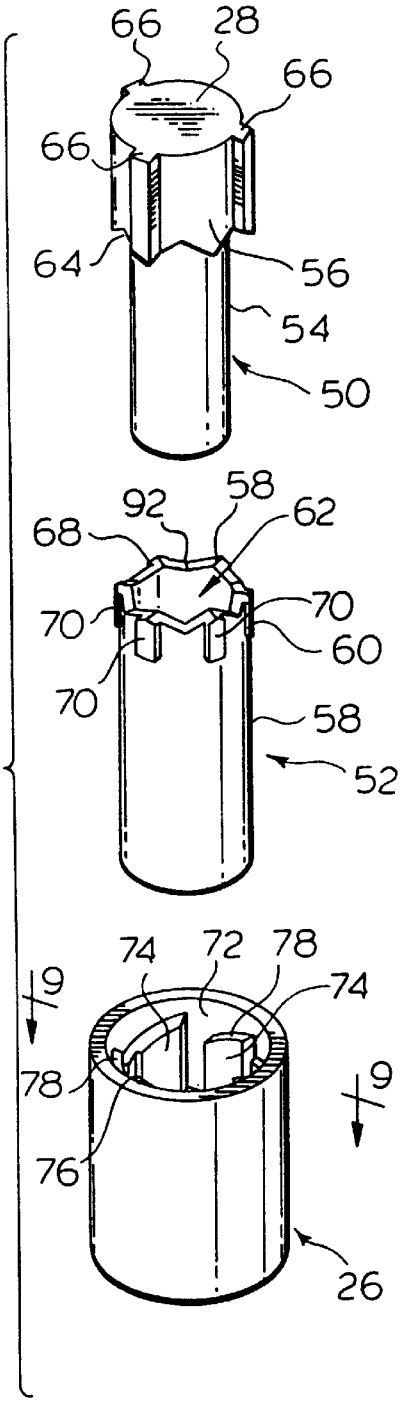
FIG. 6 is an exploded view of FIG. 4.
Figure 10:
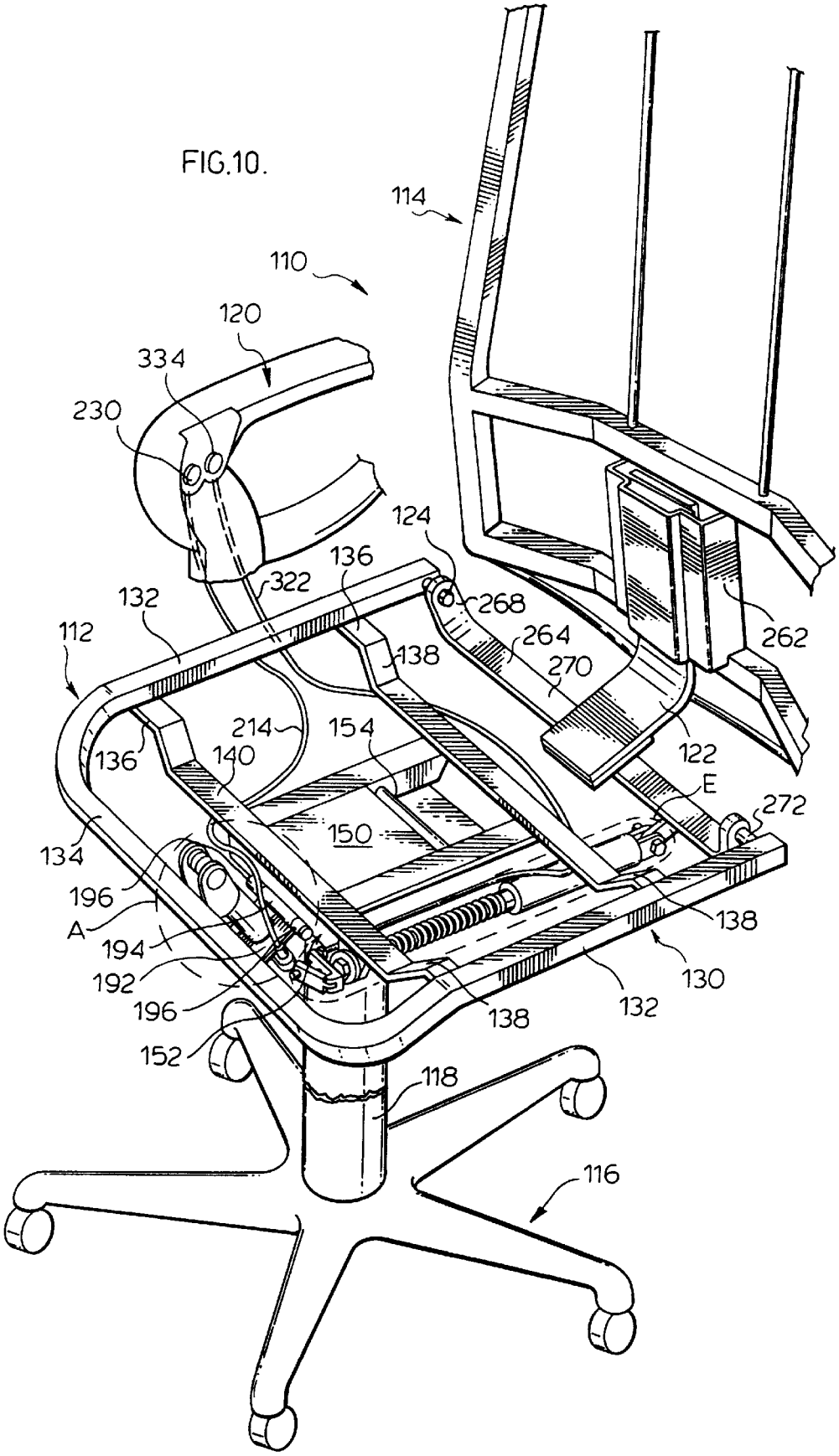
Figure 11:
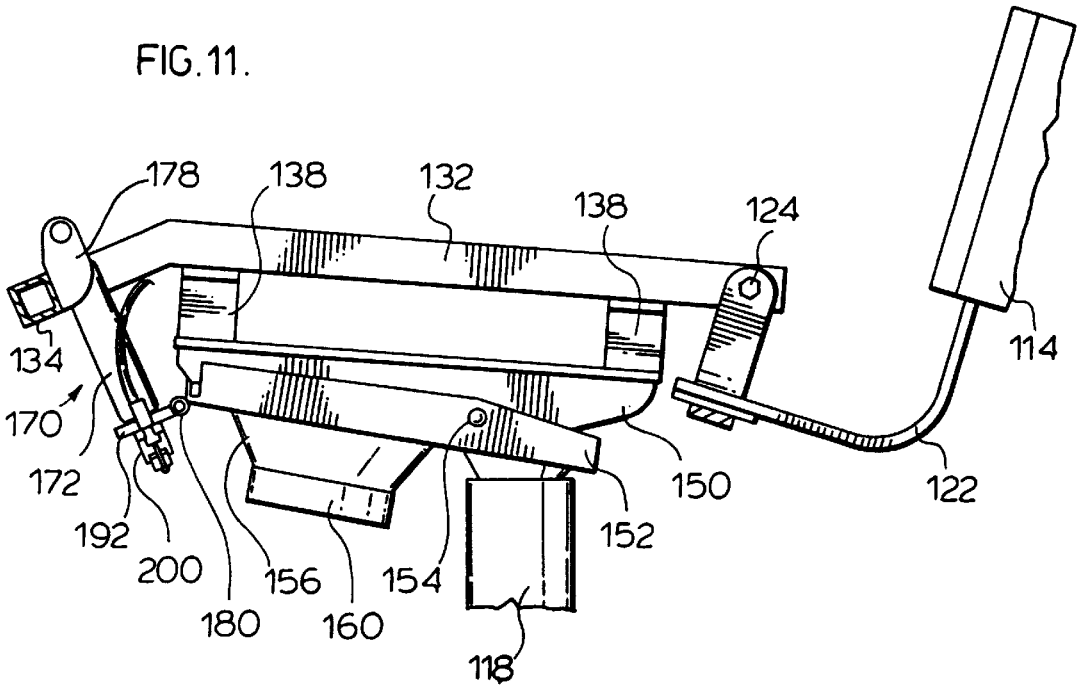
Figure 12:
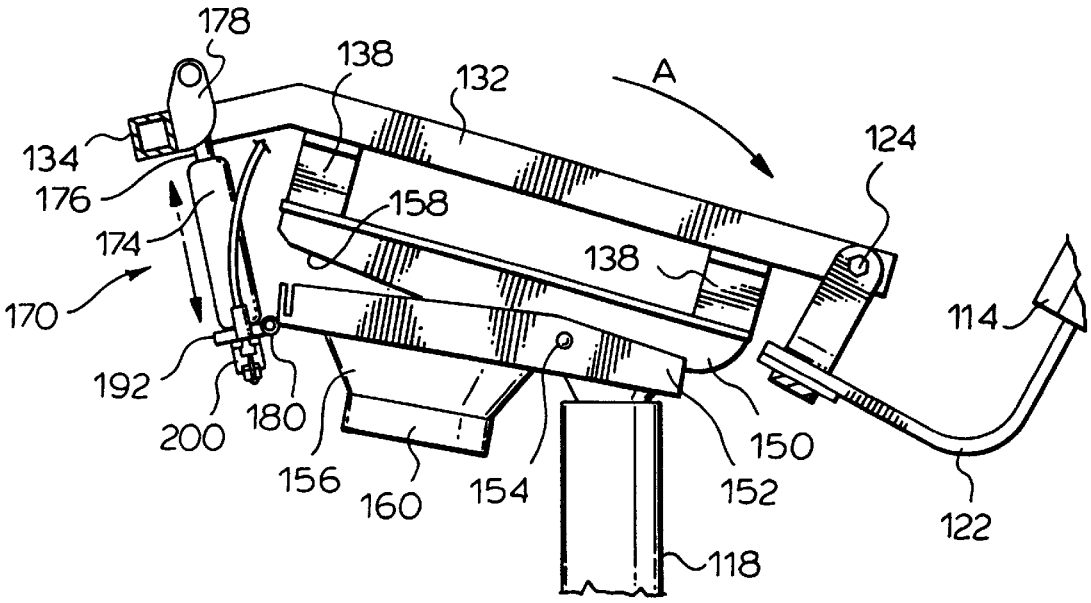
Figure 13:
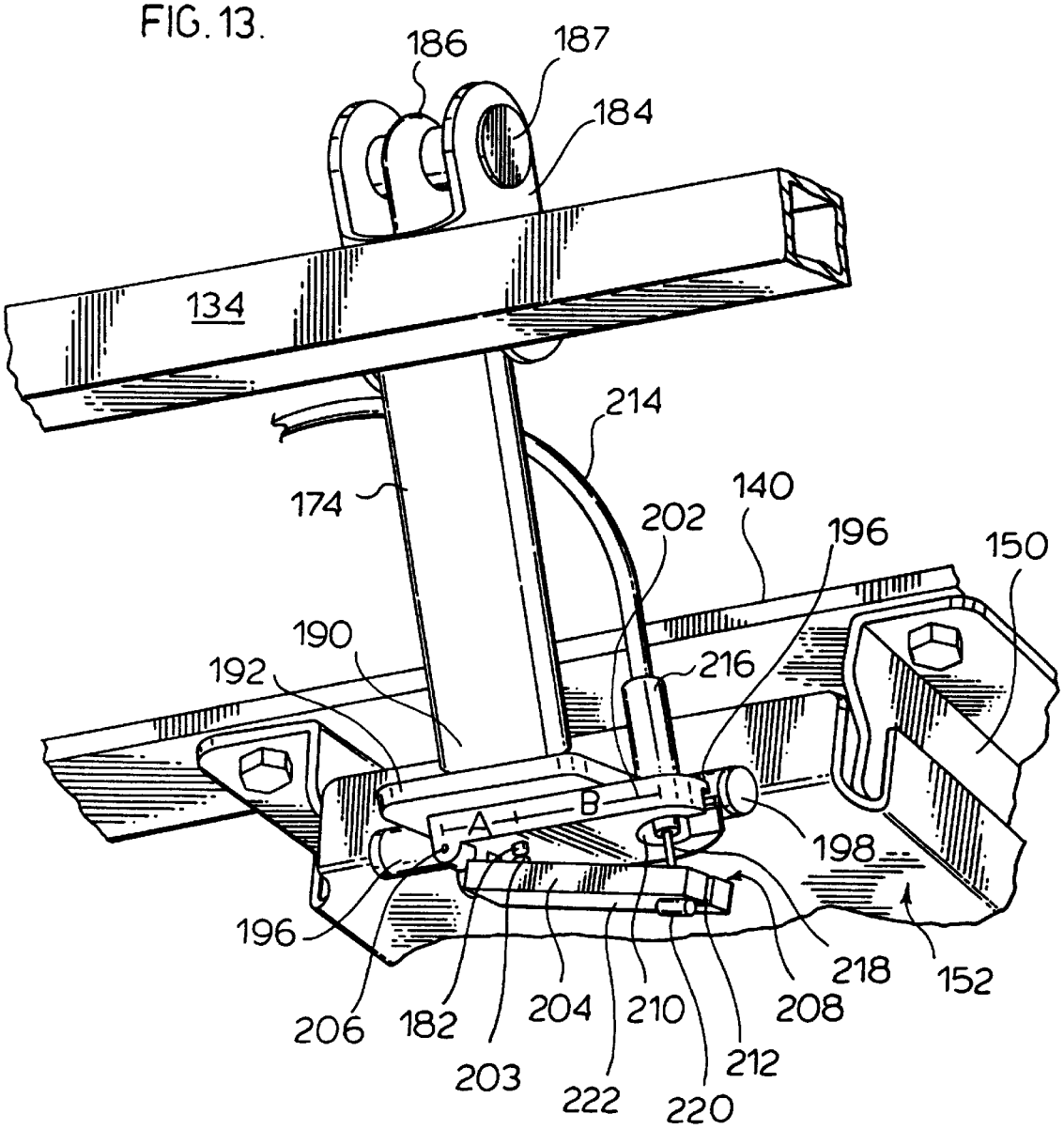
Figure 14:
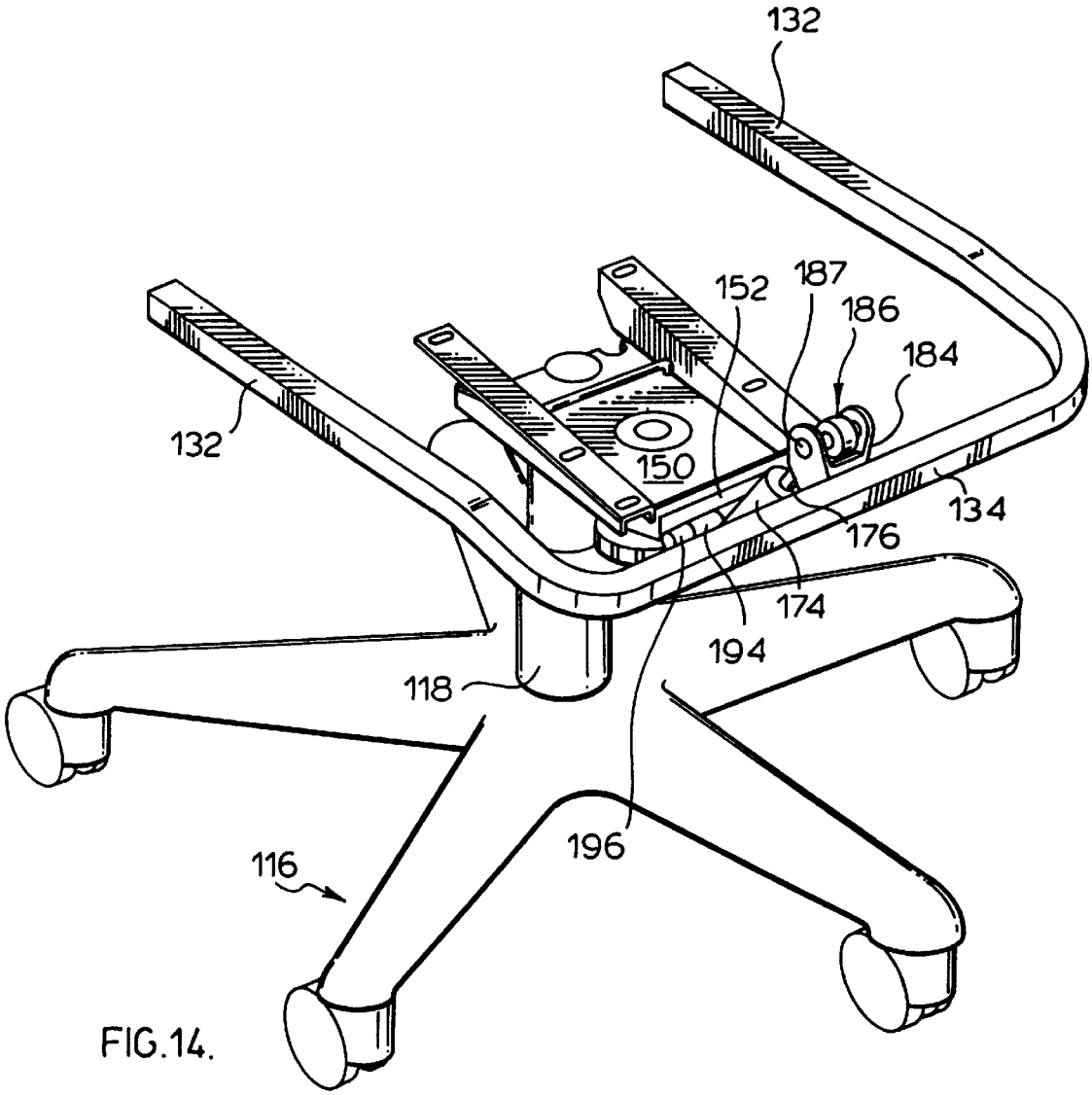
Figure 15:
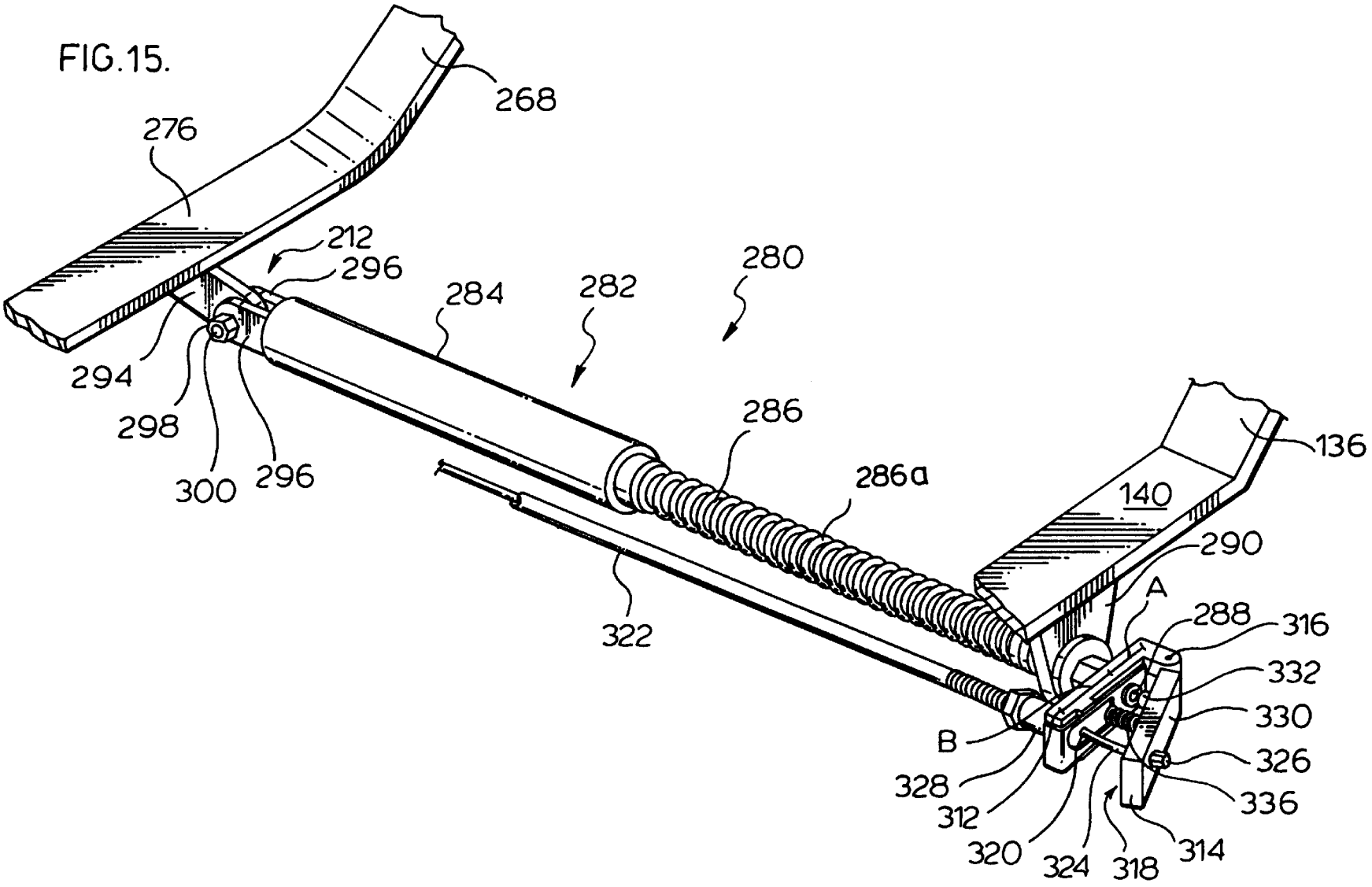
Figure 16:
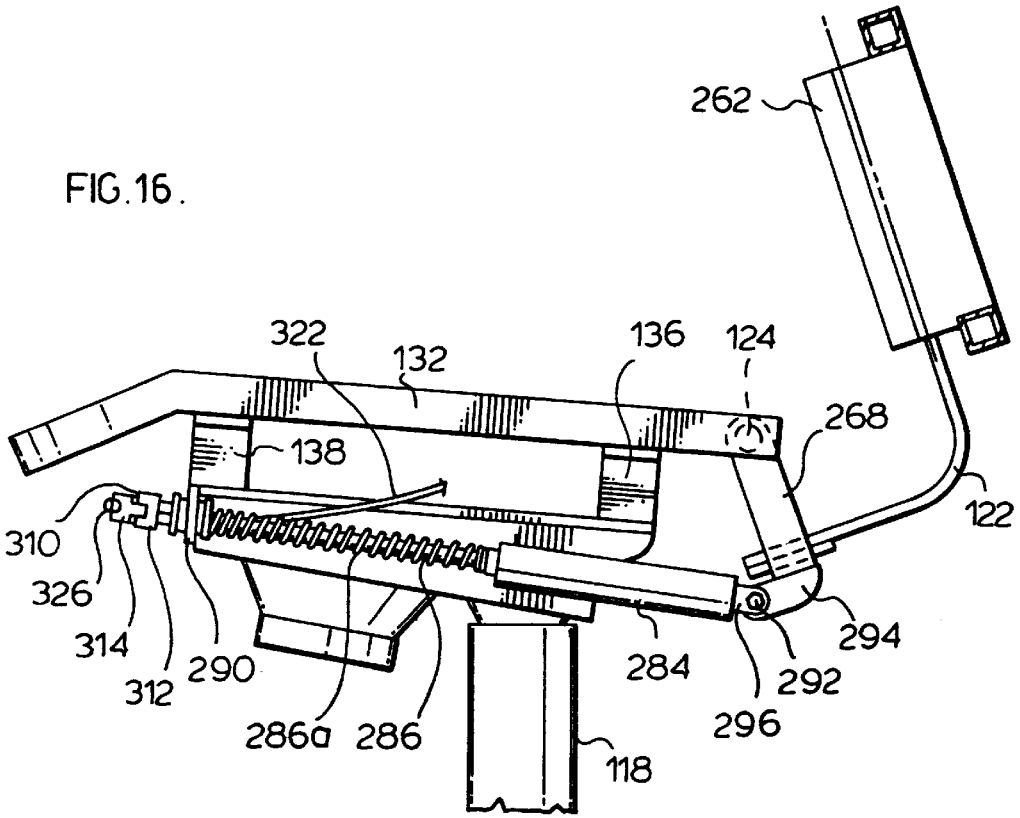
Figure 17:
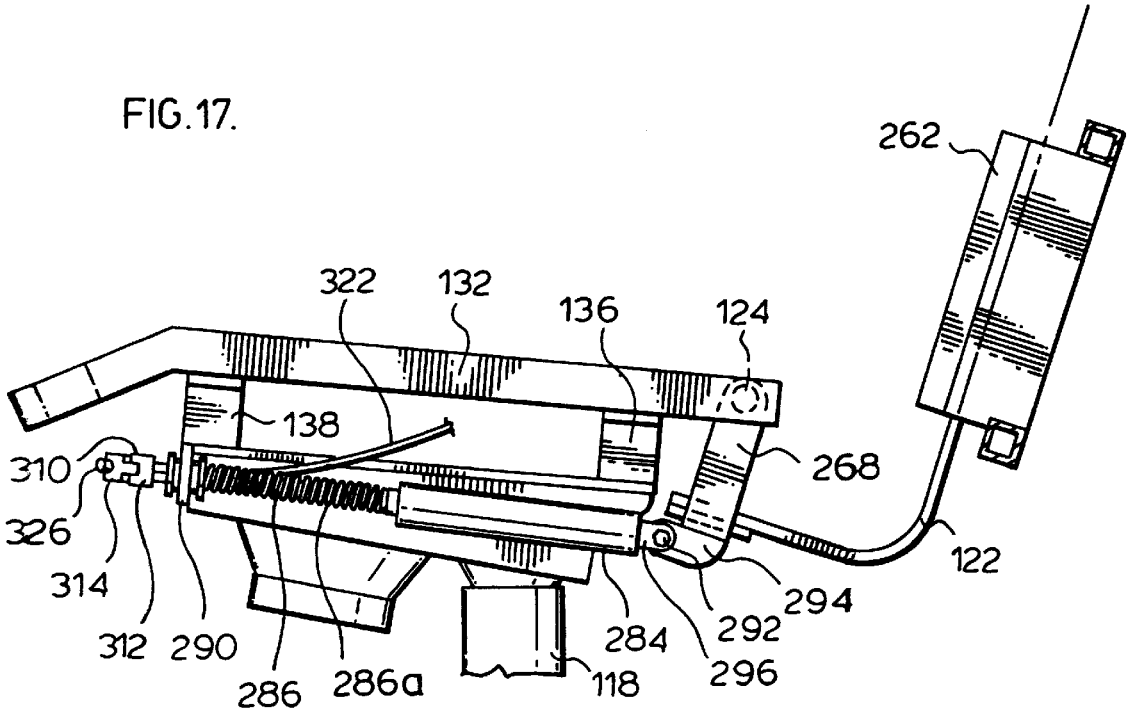

FIG. 7*a* is a top plan view of the outer member shown in FIG. 6;

FIG. 7*b* is an elevational view of the outer member shown in FIG. 6;

FIG. 8*a* is a top plan view of the inner member shown in FIG. 6;

FIG. 8*b* is an elevational view of the inner member shown in FIG. 6;

FIG. 9*a* is a top plan view of the housing shown in FIG. 6;

FIG. 9*b* is a cross sectional view along the line 9—9 in FIG. 6;

FIG. 10 is a perspective view of a chair according to the instant invention;

FIG. 11 is a side view of the chair of FIG. 10 showing the seat member adjustment mechanism in which the seat member of the chair is in the horizontal position;

FIG. 12 is a side view of the chair of FIG. 10 showing the seat member adjustment mechanism in which the seat member of the chair is in an inclined position;

FIG. 13 is an enlarged front view of detail A of FIG. 10 in which the seat member of the chair is in the horizontal position;

FIG. 14 is an enlarged front view of detail A of FIG. 10 in which the seat member of the chair is in an inclined position;

FIG. 15 is an enlargement of detail E of FIG. 10;

FIG. 16 is a side view of the chair of FIG. 10 showing the chair back member adjustment mechanism in which the chair back is in an uptight position; and, FIG. 17 is a side view of the chair of FIG. 10 showing the chair back member adjustment mechanism in which the chair back is in an inclined position.

DESCRIPTION OF THE PREFERRED EMBODIMENT

The two position button disclosed herein may be used to actuate different mechanisms of a seating unit such as a pedestal chair. For example, the cylinder may form part of a chair and may be used to adjust the height of the chair, the inclination of the seat member of the chair or the inclination of the back rest member of the chair with respect to the seat member of the chair. In accordance with one embodiment, the button is preferably used to actuate a non-pressurized cylinder (e.g. an oil filled cylinder). Preferably, the cylinder is used to adjust the inclination of the seat member of the chair or the inclination of the back rest member of the chair with respect to the seat member of the chair. Due to its construction, the button is preferably positioned in the arm of a chair for ease of use by the user.

Figure 1A:
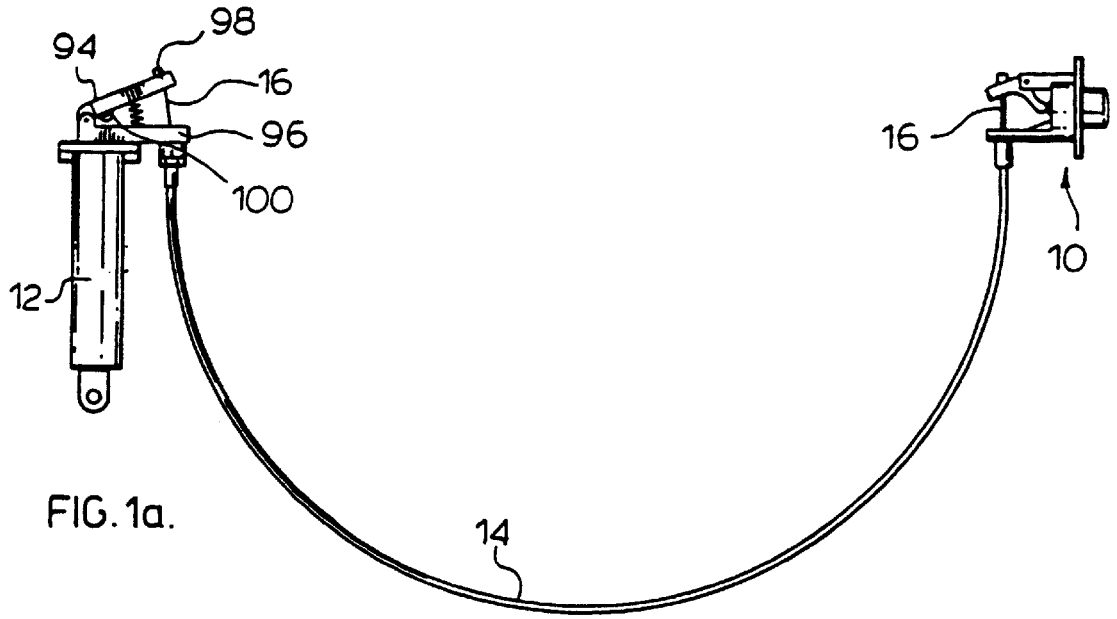
Figure 1B:
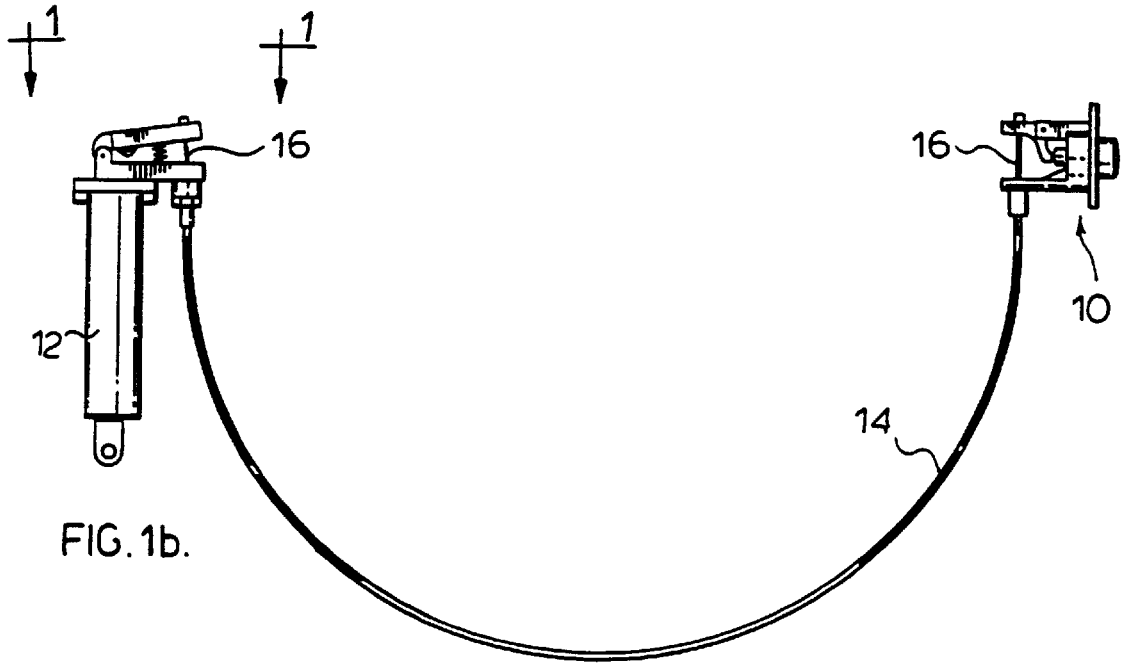

FIGS. 1*a* and 1*b* show a schematic of the two position button when used in this environment. As shown therein, button means 10 is used to actuate cylinder 12 via cable 14. Cable 14 may comprise a braided wire 16 which is positioned within a plastic sheet or the like to ensure free movement of wire 16.

Figure 2:
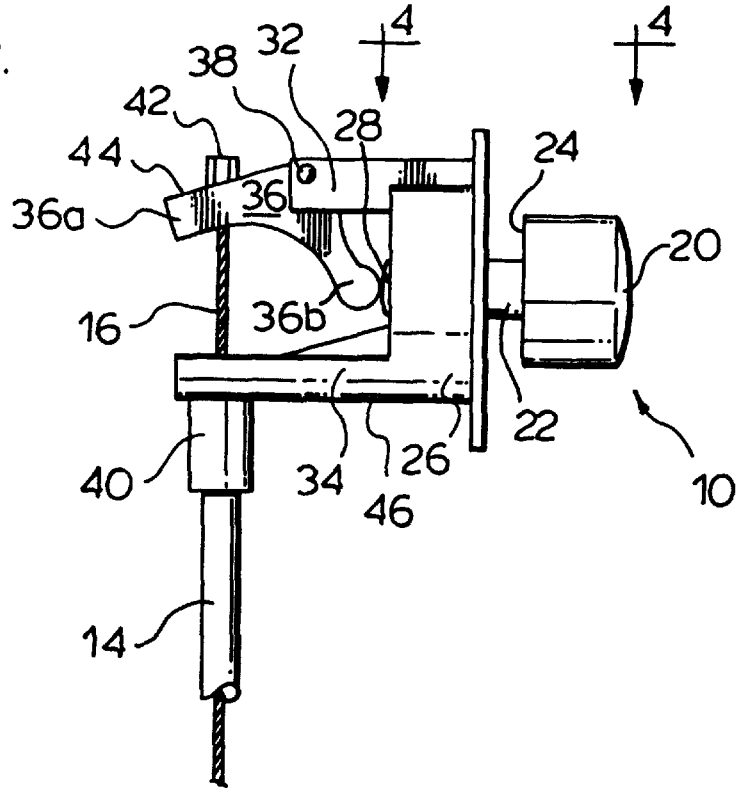
FIG. 2 is an enlargement of the button according to the instant invention showing the button in the closed position.
Figure 3:
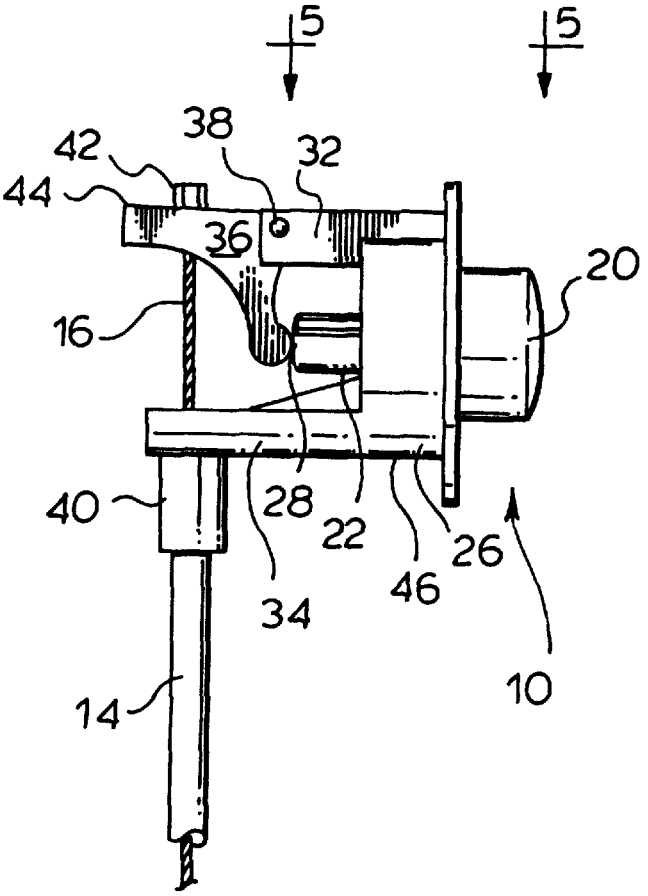
FIG. 3 is an enlargement of the button according to the instant invention showing the button in the open position.

Referring to FIGS. 2 and 3, button means 10 is shown in its first (closed) position and its second (open) position. Button means 10 may comprise button 20 and transversely extending member 22. Transversely extending member 22 extends outwardly from rear surface 24 of button 20. Transversely extending member 22 extends through opening 30 (see FIG. 9*a*) in housing 26. Transversely extending member 22 has distal end 28.

Housing 26 may have a first arm 32 and a second arm 34. Cam member 36 is pivotally mounted by pivot pin 38 to the distal end of first arm 32. Cable 14 has a shoulder member 40 and the end of wire 16 connected to button means 10 has an enlarged end 42. Cam member 36 is provided with an opening (not shown) through which wire 16 passes. Enlarged end 42 is retained against surface 44 of cam member 36 such as by providing a recess in which enlarged end 42 is seated. Second arm member 34 has an opening (not shown) through which wire 16 passes. Shoulder member 40 abuts against surface 46 of second arm 34.

It will be appreciated that wire 16 may be retained in cam member 36 by any means known in the art. Wire 16 may be fixedly attached thereto (e.g. by welding, gluing or the like). Alternately, wire 16 may be removably connected thereto for ease of repair, such as by the means described above, in case wire 16 should break.

Figure 4:
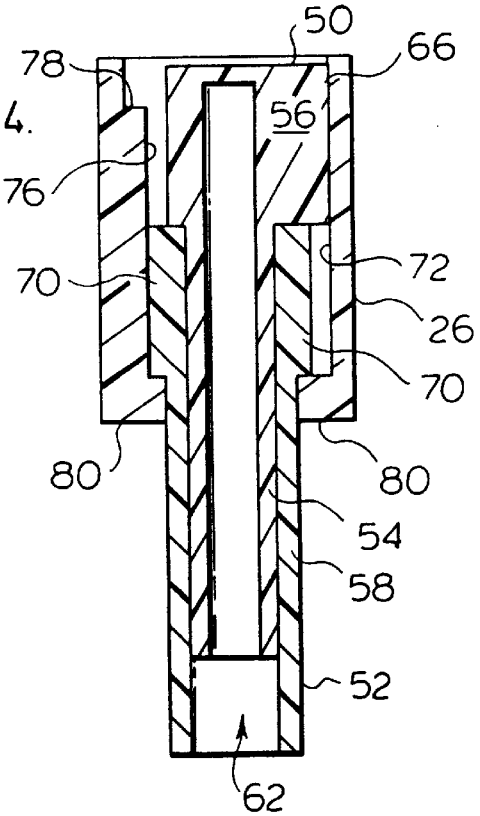
FIG. 4 is a cross section along the line 4—4 in FIG. 2.
Figure 5:
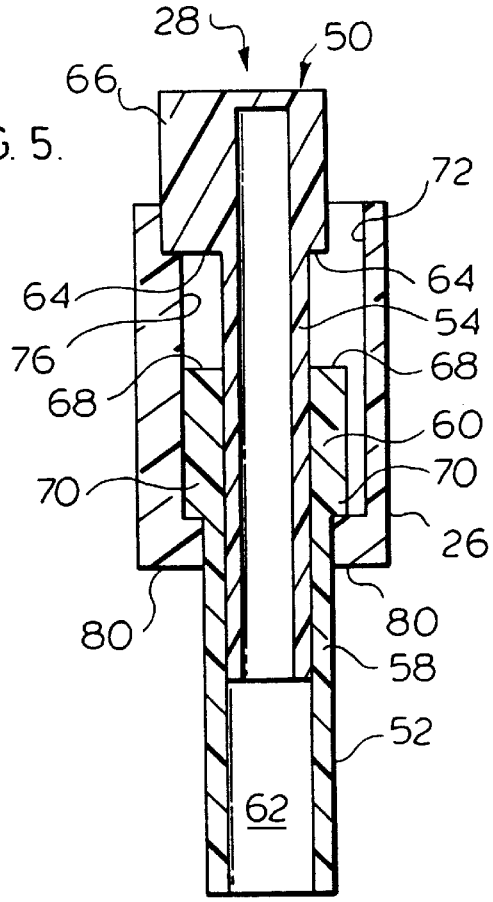
FIG. 5 is a cross section along the line 5—5 in FIG. 3.

Button means 10 is preferably associated with a locking means to maintain button 20 in each of the first and second positions into which it may be moved. The locking means preferably comprises part of button means 10. For example, as shown in FIGS. 4 and 5, transversely extending member 22 comprises inner member 50 and outer member 52. Inner member 50 is slidably positioned in inner member 52. Inner member 50 comprises a cylindrically shaped longitudinally extending member 54 and engagement member 56. Similarly, outer member 52 comprises a longitudinally extending member 58 and engagement member 60. Outer member 52 is hollow so as to define an opening 62 extending at least substantially therethrough. Inner member 50 and outer member 52 are sized so that longitudinally extending member 54 may be slidably received in opening 62.

Engagement member 56 has a toothed surface 64 positioned distal to distal 28. Toothed surface 64 has a plurality of crests 86 and a plurality of troughs 90 (see FIG. 8*b*). Further, engagement member 56 has a plurality of protrusions 66 equidistantly spaced around engagement member 56.

Engagement member 60 of outer member 52 has a toothed surface 68 and a plurality of protrusions 70 equidistantly spaced around engagement member 60. Toothed surface 68 has a plurality of crests 88 and a plurality of troughs 92 (see FIG. 7*b*). Protrusions 70 have a surface 71 positioned distal to toothed surface 68.

Housing 26 has an opening extending therethrough having an inner surface 72. Positioned on inner surface 72 are a plurality of first raised members 74 and a plurality of second raised members 76 which are spaced around inner surface 72. Members 74 and 76 define first channels 82 and second channels 84 which are equidistantly spaced around inner surface 72. As best shown in FIG. 9*a*, first and second raised surfaces are set out in sequence around inner surface 72 as follows. Starting at any particular point, a first raised member 74 is provided. Adjacent this, a second raised member 76 is provided. Adjacent thereto, another first raised member 74 is provided. This sequence of members defines a second channel 84. This pattern is repeated in equidistance spacing around inner surface 72. Neighbouring first raised members 74 define first channels 82. As shown in FIG. 9*a*, three such series may be provided.

The upper surface of first and second raised members 74 and 76 define a plurality of discrete cam surface 78. As best shown in FIG. 9*b*, the cam surfaces 78 are circumferentially angled. Outer member 80 is provided on housing 26 at a position opposed to button 20. As shown in FIG. 9*a*, housing 26 has an opening 30 which extends therethrough. Outer member 80 defines an opening which is sized to slidably receive longitudinal member 58.

Inner member 50 is slidably mounted inside outer member 52. When inner member 50 is fully inserted into outer member 52, toothed surface 64 of inner member 50 engages toothed surface 68 of outer member 52. Toothed surfaces 64 and 68 are sized and shaped so that when inner member 50 is fully inserted into outer member 52, rotation of outer member 52 causes inner member 50 to rotate. When toothed surfaces 64 and 68 are spaced apart, inner and outer members 50 and 52 may independently rotate without causing the other member to rotate.

Longitudinally extending member 58 of outer member 52 is sized so as to freely rotate in the opening provided in outer member 80. Accordingly, as shown in FIGS. 4 and 5, when button means 10 is assembled, inner member 50 is positioned inside outer member 52 and outer member 52 is positioned inside housing 26. A portion of outer member 52 extends through the opening provided in outer member 80.

Protrusions 70 of outer member 52 are sized so as to permit engagement member 60 to be received within housing 26 as shown in FIG. 5. Accordingly, the circumference of engagement member 60 (as measured around the circle defined by the outer surface of protrusion 70), is less than the diameter of the opening in housing 26 defined by the inner surface of second raised members 76. Thus, protrusions 70 may be received in both first channels 82 and second channels 84.

Protrusions 66 of engagement member 56 define a circle having a diameter smaller than the diameter defined by inner surface 72 of housing 26 but larger than the diameter defined by the inner surface of second raised members 76. Accordingly, protrusions 66 may be received in first channels 82 but not in second channels 84.

The operation of the two position button will now be described with reference to FIGS. 2–5. When button 20 is in the position shown in FIG. 2, outer member 52 is fully inserted into housing 26 so that engagement member 60 is in contact with outer member 80 of housing 26. Further, inner member 50 is positioned in housing 26. Accordingly, each protrusion 70 is aligned with a channel 82 or 84 and each protrusion 66 is aligned with a first channel 82. In the position shown in FIG. 4, toothed surfaces 64 and 68 do not fully engage. Instead, toothed surfaces 64 and 68 are slightly offset so that the crests of toothed surface 64 are positioned slightly forward of crests 88 of toothed surfaces 68.

When button 20 is pushed inwardly, towards the position shown in FIG. 3, movement of button 20 towards housing 26 causes outer member 52 to travel inwardly into housing 26. When outer member 52 undergoes a translational inward motion, the contact between toothed surfaces 64 and 68 causes inner member 50 to undergo a similar translational movement. Accordingly, when button 20 is fully depressed, inner member 50 travels sufficiently far so that engagement member 56 is positioned outside housing 26. At this position, inner member 50 is freely rotatable within outer member 52. As will be appreciated by the discussion hereinafter, cam member 36 applies an opposed translational outward pressure to engagement member 56. This pressure causes toothed surface 64 of engagement member 56 to cam along toothed surface 68 until crests 86 are positioned in troughs 92 and, similarly, crests 88 are positioned in troughs 90. This motion causes inner member 50 to rotate around its axis with respect to housing 26. This rotation of inner member 50 with respect to housing 26 causes protrusions 66 to be out of alignment with first channels 82.

When button 20 is released by the user, the pressure applied to engagement member 56 by cam member 36 causes inner and outer members 50 and 52 to undergo a translational outward motion and button 20 accordingly moves outwardly to the position shown in FIG. 3. As outer member 52 enters housing 26, lower surfaces 71 of protrusions 70 engage cam surfaces 78. Surfaces 71 cam along surfaces 78 until each protrusion 70 is aligned with either a first or second channel 82 or 84. At this position, outer member 52 may travel inwardly into housing 26 until the position shown in FIG. 5 is achieved. As inner member 50 moves into housing 26, protrusions 66 engage cam surfaces 78. As cam surfaces 78 are inclined circumferentially inwardly into housing 26, continued pressure on engagement member 56 by cam member 36 causes toothed surface 64 to cam along cam surfaces 78, further rotating inner member 50 with respect to housing 26. This rotation of inner member 50 is terminated when protrusions 66 engage sides 75 of first raised members 74. This is the position shown in FIG. 5. In this position, engagement between toothed surface 64 and cam surface 78 of second raised surface 76 prevents further inward motion of inner member 50 and accordingly the button is locked in the second position.

When it is desired to move the button to the first position (FIG. 2), the button is again depressed inwardly. The inward motion of button 20 causes translational inward motion of outer member 52. Outer member 52 again engages inner member 50 causing inner member 50 to move outwardly from housing 26. Once protrusions 66 are positioned outside housing 26, inner member 50 is again freely rotatable within outer member 52. Due to the rotation which occurred when inner and outer members cammed along cam surface 78, crests 86 and 88 are slightly off-set. The pressure exerted by cam member 36 against engagement member 56 again causes toothed surface 64 to cam along toothed surface 68 until crests 86 are positioned within trough 92 and crests 88 are positioned within troughs 90.

When button member 20 is released, cam member 36 causes inner and outer members 50 and 52 to undergo a translational outward motion. As outer member 52 enters housing 26, lower surfaces 71 of protrusions 70 engage cam surfaces 78. Surfaces 71 cam along surface 78 until each protrusion 70 is aligned with either a first or second channel 82 or 84. At this position, outer member 52 may travel inwardly into housing 26 until the position shown in FIG. 4 is achieved. Similarly, as inner member 50 enters housing 26, protrusions 66 engage cam surface 78 and cam along this surface until each protrusion 66 is in alignment with a first channel 82. In this position, inner member 50 may travel inwardly into housing 26 until the position shown in FIG. 4 is achieved. In this position, the button means is again locked in the first position. It will be appreciated that protrusions 66 and 70 are positioned relative to first and second channels 82 and 84 so that when inner and outer members 50 and 52 are received in opening 30, crests 86 are positioned offset from troughs 92 and when inner member 50 is moved outwardly to a position at which it is freely rotatable, the offset will cause inner member 50 to rotate relative to outer member 52.

As shown in FIGS. 1*a* and 1*b*, cable 14 is connected to actuator 94 which is positioned at one end of cylinder 12. Actuator 94 may have stationary arm 96 and pivoting arm 98. A spring may be positioned, for example, around wire 16 between arms 96 and 98 to bias arms 96 and 98 to the position shown in FIG. 1*a* (see for example spring FIG. 15). Preferably, cylinder 12 has two internal chambers which are isolated from each other by means of a valve (not shown). When the valve is open, fluid may flow from one chamber to the other thus allowing a telescopically expandable piston to expand outwardly, or contract inwardly, with respect to the stationary housing of cylinder 12. Cylinder 12 has a valve release pin 100. When valve release pin 100 is in the closed position, then the valve is closed and the two chambers are isolated from each other so that the piston is fixed in the position with respect to the housing. When valve release pin 100 is moved to the open position, the valve is open and the two chambers are allowed to communicate permitting the piston to expand outwardly from or inwardly into the housing. Cylinder 12 is preferably a non-pressurized cylinder (i.e. when the valve is open, the pressure in the cylinder will not cause the piston to move either inwardly or outwardly). If cylinder 12 is a pneumatic (i.e. pressurized cylinder), then arms 96 and 98 of actuator 94 must have a large movement arm so that the button may be easily actuated by the pressure applied through a finger of the user.

When the user wishes to adjust cylinder 12, they push inwardly on button 20 with, for example, their thumb. This causes button 20 to move to the recessed position shown in FIG. 3. When button 20 is pushed inwardly, transversely extending member 22 pushes on cam member 36 moving cam member 36 to the position shown in FIG. 3. This movement of cam member 36 causes wire 16 to draw arm 96 towards stationary arm 94 (it moves to the position shown in FIG. 1*b*). By this movement, valve release pin 100 is forced inwardly into cylinder 12 thus permitting the piston of cylinder 12 to telescope either inwardly or outwardly with respect to the housing.

When it is desired to fix cylinder 12 in a desired position, the user again pushes and releases button 20 moving it to the closed position shown in FIG. 2, thus permitting valve release pin 100 to move arm 98 to the distal position shown in FIG. 1*a* and thus closing the valve.

The pressure required to move button 20 may vary from about 5 to about 10 pounds and, more preferably, is about 8 pounds. If the pressure required to move button 20 is less than about 5 pounds, then button 20 may be accidentally actuated by the user brushing against. If the pressure is greater than about 10 pounds, then the pressure may be too great for many users to easily move button 20. It has been found that a pressure of about 8 pounds is optimal.

Button 20 preferably has a relatively short stroke between the closed position shown in FIG. 2 and the opened position shown in FIG. 3. Preferably, the distance travelled by button 20 may be about up to ¾ inch but, preferably, is about ½ inch and may be about ¼ inch. Depending on the relative length of arms 36*a* and 36*b* of cam 36, the distance travelled by wire 16 may vary as button 20 travels between the two positions. A ½ inch movement of the button may cause wire 16 to travel ½ inch if arms 36*a* and 36*b* are substantially the same length.

As button 20 is utilized, wire 16 may become stretched. In order to ensure correct positioning of pivoting arm 98, as well as a full stroke for pivoting arm 98, adjustment means 102 may be provided. Adjustment means 102 may comprise a threaded opening 104 in stationary member 96 which receives threaded member 106 which is provided at the end of cable 14. Nut 108 is provided to secure threaded member 106 in the desired position.

Figure 1C:
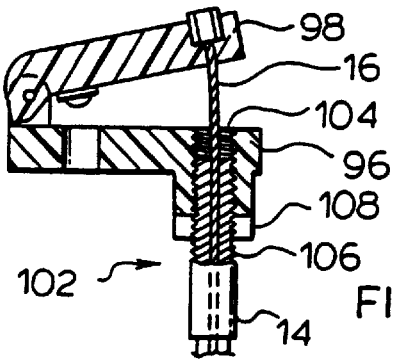

By turning stationary arm 104 relative to threaded member 106, threaded member may be moved alternately further into or further out of threaded opening 104. Movement of member 106 accordingly adjusts the amount of cable extending between arms 96 and 98. Accordingly, the open position of pivoting arm 98 (as shown in FIG. 1*a*), may be increased or decreased. When member 106 is in the desired position, nut 108 may be moved to the position shown in FIG. 1*c* to prevent further lengthening of wire 16.

It will be appreciated by those skilled in the art that various modifications of button means 10 may be permissible. For example, if cylinder 12 is actuated by the outward movement of valve release pin 100, then button means 10 could be designed to release tension in wire 16 permitting the expansion outwardly of valve release pin 100, as opposed to providing a tensional force thereto as shown herein. Further, as will be appreciated by those skilled in the art, the exact configuration and orientation actuator 94 may be varied.

A chair may have a seat member which may be inclined. Referring to FIGS. 10–14, the use of a button, and preferably a two position button, to control the inclination of the seat member of a chair will now be discussed.

Referring to FIG. 10, a pedestal chair is shown. For ease of reference, the foam padding of the chair has been removed so only the frame members are visible. The frame members may be made of any particular material which provide sufficient strength for the chair. Preferably, the frame members are made from metal. Chair 110 comprises seat member 112, chair back member (which may be referred to as a back rest member) 114, wheeled base 116 and support leg 118 extending between seat member 112 and wheeled base 116. Arms 120 are provided at opposite sides of seat member 112. For clarity, only one arm has been shown in FIG. 10.

In the embodiment of FIGS. 10–14, chair back member 114 is affixed to seat member 112 by back support member 122. As will be appreciated by those skilled in the art, the chair need not have a chair back. If the chair includes a chair back, then various means are known in the art for fixing chair back 114 to seat member 112. Chair back 114 may be pivotally mounted by means of pivot means 124 to seat member 112 so that the angle of inclination of chair back 114 can be varied with respect to seat member 112. Alternately, chair back 114 may be fixed in position with respect to seat member 112.

Optionally, means may be provided to adjust the height of the chair. Accordingly, support leg 118 may comprises a telescopically expanding cylinder having upper and lower sections (not shown). Such cylinders are generally known in the art and have two internal chambers which are isolated from each other by means of a valve. When the valve is opened, fluid may flow from one chamber to the other thus allowing the upper section to expand upwardly, or contract downwardly, so as to adjust the height of the chair.

Seat member 112 may comprise frame 130 having longitudinal side portions 132 and transverse front portion 134. Additional reinforcement is provided to frame 130 by transverse struts 136 which extend between longitudinal side portions 132.

Struts 136 may be affixed to the lower side of the longitudinal side portions 132 by any means known in the art. For example, if side portions 132 and struts 136 are made of metal, struts 136 may be welded or bolted to side portions 132. In the preferred embodiment of FIG. 10, each strut 136 has descending portions 138 which are connected by horizontal portion 140. Horizontal portion 140 provides a mounting platform for leg support 118 which is positioned below seat member 112.

Seat member 112 is pivotally mounted with respect to support leg 118 so that it may rock back and in the arc represented by arrow A in FIG. 12. Referring to FIGS. 11 and 12, upper mounting plate 150 is affixed to the lower surface of horizontal portion 140 of struts 136. Once again, upper mounting plate 150 may be affixed by any means known in the art (eg. welding or bolting) to horizontal portions 140 if these components are made of metal. Lower mounting plate 152 is affixed to the upper portion of support leg 118 by any means known in the art. Upper mounting plate 150 is pivotally mounted with respect to lower mounting plate 152 by means of pivot pin 154 which extends transversely through openings (not shown) in upper and lower mounting plates 150, 152. Accordingly, seat member 112 may be pivoted from the horizontal position shown in FIG. 11 to the rearwardly inclined position shown in FIG. 12.

Preferably, seat member 112 may be biased, eg., into the generally horizontal position by spring means as is known in the art (not shown). The spring means may be mounted in spring housing 156 and extend from spring housing 156 to lower surface 158 of upper mounting plate 150 as is known in the art. Further, tensioning means may be provided such as knob 160, to adjust the tension in the spring means.

As shown in FIGS. 11 and 12, infinite tilt adjustment mechanism 170 comprises cylinder 172 having stationary housing 174, telescopically expandable piston 176 mounted therein and valve release pin 182. Cylinder 172 preferably extends generally vertically and is preferably mounted at the front portion of chair 110. Cylinder 172 is preferably pivotally mounted on chair 110 by means of upper pivot mount 178 and lower pivot mount 180.

Cylinder 172 may be a fluid cylinder and is preferably filled with a non-compressible fluid (e.g. oil). Cylinder 172 has two internal chambers which are isolated from each other by means of a valve (not shown). When the valve is opened, fluid may flow from one chamber to the other thus allowing telescopically expandable piston 176 to expand upwardly, or contract downwardly, with respect to stationary housing 174. When valve release pin 182 is in the closed position, then the valve is closed and the two chambers are isolated from each other so that piston 176 is fixed in position with respect to housing 174. Accordingly, the tilt or inclination of the chair with respect to the horizontal is fixed in position when valve release pin 182 is in the closed position. When valve release pin 182 is moved to the open position, then the valve is open and the two chambers are allowed to communicate permitting piston 176 to expand outwardly from housing 174 or to contract inwardly into housing 174 so that the inclination at seat member 112 may be adjusted either upwardly or downwardly.

Referring to FIG. 13, the upper portion of cylinder 172 may be pivotally mounted by means of upper pivot mount 178. Upper pivot mount 178 comprises mounting bracket 184 which is affixed to transverse front portion 134 (e.g. by welding or bolting if these elements are made of metal). Piston 176 has upper portion 186 which is positioned within bracket 184. Upper portion 186 and bracket 184 have openings provided therein through which pivot pin 187 may pass.

The lower portion of cylinder 172 may be pivotally mounted as follows. Housing 174 may have lower portion 190 which is fixed to plate 192 (e.g. by welding). The rear portion of plate 192 is affixed to tubular bracket member 194 (see FIG. 10). Alternately, tubular bracket member 194 may be integrally formed as part of plate 192. Lower mounting plate 152 is provided with tubular bracket members 196 which may be affixed thereto eg. by welding. Tubular bracket members 196 and tubular bracket member 194 are positioned so as to define a longitudinally extending channel through which pivot pin 198 may extend.

As will be appreciated by referring to FIGS. 11 and 12, when seat member 112 is adjusted from the generally horizontal position to an inclined position, the angle between cylinder 172 and lower mounting plate 152 as well as the angle between cylinder 172 and front portion 134 will vary slightly. By pivotally mounting cylinder 172 with respect to both lower mounting plate 152 and front portion 134, no tensional or bending stresses are imparted to cylinder 172 and accordingly piston 176 may smoothly travel into and out of housing 174.

Actuator 200 may be any actuator that is adapted to operate a cylinder 172 and may be mounted on the lower surface of plate 192. Preferably, actuator 200 has a stationary arm 202 and pivoting arm 204 which is pivotally connected to stationary arm 202 by pivot pin 206. Stationary arm 202 may be affixed to plate 192 by any means known in the art that provides a fixed amount for pivot pin 206. As will be appreciated, stationary arm 202 may be of any particular shape that provides a fixed mount for pivot pin 206. Pivoting arm 204 has inner surface 208.

The distal end of arm 202 from pivot pin 206 is provided with opening 210. Similarly, the distal end of pivoting arm 204 from pivot pin 206 is provided with opening 212. Cable 214 comprises, e.g. a braided wire 218, which is held within a plastic like housing to permit smooth movement of wire 218 therein. Wire 218 is provided with enlarged end 220. Cable 214 is provided with shoulder member 216 which abuts against stationary arm 202. Wire 218 passes through openings 210 and 212. Enlarged end 220 is retained on outer surface 222 of pivoting arm 204, such as by providing a recess in which enlarged end 220 is seated, while permitting wire 218 to pass through openings 210 and 212.

An opening is provided in stationary arm 202 so that, as pivoting arm 204 moves from position shown in FIG. 1*a* to the position shown in FIG. 1*b*, valve release pin 182 is moved from the closed position (in which piston 176 is fixed in position with respect to housing 174) to the open position (in which piston 176 may move with respect to housing 174). To this end, as shown in FIG. 13, valve release pin 182 may extend outwardly through stationary arm 202. Inner surface 208 of pivoting arm 204 may be flat so that as arm 204 pivots towards stationary arm 202 (to the position shown in FIG. 1*b*) valve release pin 182 is depressed into housing 174 thus opening the valve. Alternately, it will be appreciated that protrusion 203 or other button means may be provided on inner surface 208 to contact valve release pin 182 and that valve release pin 182 may be recessed within stationary arm 202 if protrusion 203 is of sufficient size.

Button means 230 is provided in arm 120. Button means 230 may comprise any button moveable between the depressed (open) position and the outward (open) position. Preferably, button means 230 comprises a button means 10 which locks in each of these positions.

The operation of the actuation means will now be described with the use of the lockable two position button shown in FIGS. 2 and 3. Referring to FIG. 13, valve release pin 182 is shown in the closed position. In this position, valve release pin 182 is in the raised position. Due to the construction of the cylinder, valve release pin 182 is biased into this position so that cylinder 172 will not be prematurely actuated. The pressure exerted by valve release pin 182 against arm 204 causes arm 204 to be maintained in the distal position with respect to stationary arm 202. This force upon arm 204 is transmitted through cable 214 and therefore retains cam member 36 in the position shown in FIG. 2. Arm 36*b* of cam member 36 transmits this force outwardly through transversely extending member 22 to button 20 so that button 20 is in the raised position shown in FIG. 2.

When the user wishes to adjust the inclination of the seat member of the chair, they push inwardly on button 20 with, for example, their thumb. This causes button 20 to move to the recessed (open) position shown in FIG. 3. When button 20 is pushed inwardly, transversely extending member 22 pushes on arm 36*b* of cam member 36 moving cam member 36 to the position shown in FIG. 3. This movement of cam member 36 causes cable 214 to draw arm 204 towards stationary arm 202. By this movement, valve release pin 182 is forced inwardly into cylinder 172 thus permitting piston 176 to telescope either inwardly or outwardly with respect to housing 174. The user may rock backwards and forwards in the chair. When the user desires to fix the seat member of the chair in a desired position, the user moves the seat member to the desired position, and presses button 20 to release button 20 permitting valve release pin 182 to move arm 204 to the distal (closed) position shown in FIG. 13 thus closing the valve. In this position, the inclination of the chair is once again fixed at a desired inclination. It will be appreciated that if a lockable button is not used, then the user must continuously depress button 230 until the seat member is in the desired position.

Referring to FIG. 13, it will be appreciated that arm 204 provides a moment arm to reduce the pressure which must be exerted by the user to move valve release pin 182 from the closed position to the open position. In particular, the distance between valve release pin 182 and cable 214, referred to by reference numeral B in FIG. 13, provides a moment arm which is substantially longer than the distance between pivot pin 206 and valve release pin 182, referred to by reference numeral A. By varying the length of moment arm B with respect to A, the amount of force which must be applied, and the distance through which cable 214 must travel, may be adjusted. Preferably, the length of moment arm B with respect to A, and it's configuration, are sufficient to permit button 230 to be depressed when a relatively low force is applied by the user, e.g. that pressure which may be applied through a finger by the average person. If moment arm B is too long, or the distance which must be travelled by arm 204 is too short, then the adjustment mechanism may be accidentally actuated by the user by merely brushing against button 230. The ratio of the distance B:A preferably varies from about 1:2 to about 1:3, more preferably, from about 1:2 to about 1:2.5 and more preferably the ratio is about 1:2.5.

By constructing actuator 200 according to this invention, the amount of pressure directed on the valve release pin 182 by pivot arm 204 may be substantially greater than the pressure required to depress button 230. Preferably, a pressure from about 10 to about 20, more preferably from about 15 to about 20 pounds, is required to move valve release pin 182 to the open position. In such a case, the pressure required to move button 230 may vary from about 5 to about 10 pounds and, more preferably, is about 8 pounds. If the pressure required to move button 230 is less than about 5 pounds, then button 132 may be accidentally actuated by the user brushing against. If the pressure is greater than about 10 pounds, then the pressure may be too great for many users to easily actuate the adjustment mechanism. It has been found that a pressure of about 8 pounds is optimal.

Generally the arms of chairs are relatively thin. Thus, to fit button 230 in arm 120 of chair 110, button 230 generally has a relatively short stroke between the released position shown in FIG. 2 and the depressed position shown in FIG. 3. Preferably, the distance travelled by button 230 may be about up to ¾ inch but, preferably, is about ⅝ inch. Correspondingly, the distance travelled by pivoting arm 204 with respect to stationary arm of 202 is preferably about ⅝ inch. Thus, due to the length of moment arm B, the ratio of the distance travelled by button 230 to the distance travelled by pivoting arm 204 permits about a corresponding increase in the magnitude of force applied by arm 204 to valve release pin 182.

A chair may have a chair back member which may be inclined. Referring to FIGS. 10 and 14–17, the use of a button, and preferably a two position button, to control the inclination of the chair back member of a chair will now be discussed.

Chair back member 114 is pivotally mounted with respect to the seat member so that the angle of inclination of chair back member 114 may be varied with respect to seat member 112. Chair back member 114 may itself be pivotally mounted to seat member 112 (eg. by mounting the frame of chair back member 114 to the frame of seat member 112). Preferably, as shown in FIGS. 10, 16 and 17, chair back member 114 is fixed to transverse rear portion 264 that is itself pivotally mounted to seat member 112. Transverse rear portion 264 is preferably pivotally mounted to longitudinal side portions 132 adjacent the rear ends of longitudinal side portions 132.

As shown in FIGS. 10, chair back member 114 has a mounting plate 262. The upper portion of back support member 122 is attached to mounting plate 262. For example, if back support member 122 and mounting plate 262 are made of metal, back support member 122 may be welded or bolted to mounting plate 262. Alternately, back support member 122 may be slidably received in mounting plate 262 so that the height of chair back member 114 may be adjusted with respect to seat member 112. Back support member 122 may be received in a opening in mounting plate 262 which is dimensioned to fixedly hold back support member 122 in place. Similarly, the lower portion of back support member 122 is attached to transverse rear portion 264. For example, if back support member 122 and transverse rear portion 264 are made of metal, back support member 122 may be welded or bolted to transverse rear portion 264.

Transverse rear portion 264 is preferably pivotally secured to the rear portions of longitudinal side portions 132 by pivot means 124. Transverse rear portion 264 may have descending end portions 268 and central horizontal portion 270. Pivot means 124 may be any means known in the art. For example, pivot means 124 may comprise a bolt having a head (positioned on the inner surface of descending portion 268), a longitudinally extending body portion (extending through descending portion 268) and an end (positioned in longitudinal side portion 132) to which a bolt is attached. A spacer 272 may be placed over a portion of the longitudinally extending body portion of the bolt. Transverse rear portion 264 may accordingly be pivotally mounted between the bolt and spacer 272. Accordingly, chair back member 114 is fixed in position with respect to transverse member 264 and pivots with respect to seat member 112 as transverse member 264 pivots. As will be appreciated, by affixing chair back member 114 to member 264 that is pivotally mounted to seat member 112, member 264 defines a moment arm which levers the force that is applied to move seat back member 114.

As shown in FIGS. 10, 13 and 14, tilt adjustment mechanism 280 is preferably mounted offset to one side, and in the plane of, seat member 112. Mechanism 280 comprises motion control fluid cylinder 282 having stationary housing 284, telescopically expandable piston 286 mounted therein and valve release pin 288. Motion control fluid cylinder 282 is preferably fixedly mounted to the forward portion of seat member 112 by means of forward mount 290 and, preferably, pivotally mounted to the rear of seat member 112 by rearward pivot mount 292.

Motion control fluid cylinder 282 may be a non-pressurized cylinder and is preferably filled with a non-compressible fluid (e.g. oil). As is known in the art, motion control fluid cylinder 282 has two internal chambers which are isolated from each other by means of a valve (not shown). When the valve is opened, fluid may flow from one chamber to the other thus allowing telescopically expandable piston 286 to expand forwardly, or contract rearwardly, with respect to stationary housing 284. When valve release pin 288 is in the closed position, then the valve is closed and the two chambers are isolated from each other so that piston 286 is fixed in position with respect to housing 284. Accordingly, the inclination of chair back member 114 is fixed in position when valve release pin 288 is in the closed position. When valve release pin 288 is moved to the open position, then the valve is open and the two chambers are allowed to communicate permitting piston 286 to expand outwardly from housing 284 or to contract inwardly into housing 284 so that the inclination chair back member 114 may be adjusted either forwardly or rearwardly.

Forward mount 290 may comprise a flange which descends from the lower surface of horizontal portion 140. The forward end of piston 286 extends through an opening in the flange and is fixedly mounted thereto. Piston 286 may be fixedly mounted thereto by any means known in the art. Therefore, any movement of piston 286 with respect to housing 284 causes housing 284 to move rearwardly.

Rearward pivot mount 292 may comprise flange 294 and extension arms 296. Referring to FIG. 15, flange 294 extends forwardly from the lower surface of horizontal portion 270. Extension arms 296 extend rearwardly from housing 284. Extension arms 296 may be pivotally connected to flange 294 by any means known in the art. Extension arms 296 are pivotally connected to flange 294 by means of bolt 298 and screw 300.

Actuator 310 may be the same as actuator 200. Actuator 310 is mounted on the forward portion of piston 286 at a position forward of mount 290. Actuator 310 has a stationary arm 312 and pivoting arm 314 which is pivotally connected to stationary arm 312 by pivot pin 316. Stationary arm 312 may be affixed to piston 286 by any means known in the art that provides a fixed amount for pivot pin 316. As will be appreciated, stationary arm 312 may be of any particular shape that provides a fixed mount for pivot pin 316. Pivoting arm 314 has inner surface 318.

The distal end of arm 312 from pivot pin 316 is provided with opening 320. Similarly, the distal end of pivoting arm 314 from pivot pin 316 is provided with an opening (not shown). Cable 322 comprises, e.g. a braided wire 324, which is held within a plastic like housing to permit smooth movement of wire 324 therein. Wire 324 is provided with enlarged end 326. Cable 322 is provided with shoulder member 328 which abuts against stationary arm 312. Wire 324 passes through the openings in arms 312 and 314. Enlarged end 326 is retained on outer surface 330 of pivoting arm 314, such as by providing a recess in which enlarged end 326 is seated, while permitting wire 324 to pass through the openings in arms 312 and 314.

An opening is provided in stationary arm 312 so that, as pivoting arm 314 moves towards stationary arm 312, release pin 288 is moved from the closed position (in which piston 286 is fixed in position with respect to housing 284) to the open position (in which piston 286 may move with respect to housing 284). To this end, as shown in FIG. 15, valve release pin may extend outwardly through stationary arm 312. Inner surface 318 of pivoting arm 314 may be flat so that as arm 314 pivots towards stationary arm 312, valve release pin 288 is depressed into housing 284 thus opening the valve. Alternately, as shown in FIG. 15, it will be appreciated that protrusion 332 or other button means may be provided on inner surface 318 to contact valve release pin 288 and that valve release pin 288 may be recessed within stationary arm 312 if the button means is of sufficient size.

As with the seat member tilt adjustment means, cable 322 is affixed to a second button means 334 as is shown in FIG. 10. The button means 334 which operates actuator 310 may be positioned beside the button means 230 which operates actuator 200. Alternately, the button means 334 which operates actuator 310 may be positioned in the other arm 120 from the button means 230 which operates actuator 200. As with button means 230, button means 334 may comprise any button moveable between the depressed (open) position and the outward (open) position. Preferably, button means 334 comprises a button means 10 which locks in each of these positions. Similarly, actuator 310 may be operated in the same manner as actuator 200.

It will be appreciated by those skilled in the art that various modifications of actuators 200 and 310 may be permissible. For example, by way of example with respect to actuator 200, if cylinder 172 is actuated by the outward movement of valve release pin 182, then button means 230 could be designed to release tension in cable 214 permitting the expansion outwardly of valve release pin 182, as opposed to providing a tensional force thereto as shown herein. Further, as will be appreciated by those skilled in the art, the exact configuration and orientation or arm 202 may be adjusted so long as a fixed mount is provided for pivot pin 206. Further, the exact configuration and orientation of arm 204 may be varied.

I claim:

1. A movable chair having a base adapted for movement across the surface on which the chair is situated, a seat member, a support member extending between the base and the seat member, the chair having a movable portion and a stationary portion to permit the reconfiguration of the chair, the chair comprising:

(a) a mechanical actuator comprising an operating member positioned proximate a surface of the chair and having first and second arms, the second arm having an axis, the second arm receiving a force applied by a user at an angle to the axis of the second arm and transmitting the force to the first arm;

(b) a retaining member for retaining said moveable portion of the chair in either of at least two positions providing different configurations of the chair, said retaining member having an element moveable between a first position in which said moveable portion is moveable between said at least two positions and a second position in which the configuration of the chair is fixed;

(c) a mechanical coupling member having a first end connected to said first arm of said member and a second end operatively connected to said retaining member; and, (d) a locking member actuated by operation of the mechanical actuator for alternately maintaining said retaining member in said first and second positions whereby, movement of said second arm causes said first arm to move so that said retaining member is actuated and the moveable portion of said chair may be adjusted relative to the stationary portion.

2. The chair as claimed in claim 1 wherein said operating member is pivotally mounted to a housing at a location between said first and second arms, said first arm extending outwardly from said operating member at a first angle and said second arm extending outwardly from said operating member at a different angle to said first angle.

3. The chair as claimed in claim 1 further comprising a transmission element operatively engaging said second arm whereby the user indirectly applies the force to the first arm via the transmission element.

4. The chair as claimed in claim 3 wherein said operating member is pivotally mounted to a housing at a location between said first and second arms and said transmission element is a separate member to said operating member.

5. The chair as claimed in claim 3 wherein said second arm has an axis and said transmission element operatively engages the second arm to apply the force to said second arm at an angle to the axis of the second arm.

6. The chair as claimed in claim 3 wherein said transmission element travels up to ¾ inches to actuate the reconfiguration of the chair.

7. The chair as claimed in claim 3 wherein said transmission element comprises a button which is mounted in a housing and comprises a longitudinally extending shaft member and said locking member comprises a first engagement member positioned on said shaft and a second engagement member provided in said housing for engaging said first engagement member.

8. The chair as claimed in claim 1 wherein said locking member comprises an engagement member associated with said actuator for alternately maintaining said retaining member in said first and second positions.

9. The chair as claimed in claim 1 wherein said mechanical coupling means further comprises a flexible cable.

10. The chair as claimed in claim 1 wherein said chair further comprises an armrest and said actuator is provided on said armrest.

11. A movable chair having a base adapted for movement across the surface on which the chair is situated, a seat member, an arm, a support member extending between the base and the seat member, the chair having a movable portion and a stationary portion, the chair comprising:

(a) a mechanical actuator positioned in the arm of the chair, said actuator being movable between a first position and a second position;

(b) a retaining member for retaining said moveable portion of the chair in either of at least two positions providing different configurations of the chair, said retaining member having an element moveable between a first position in which said moveable portion is moveable between said at least two positions and a second position in which the configuration of the chair is fixed;

(c) a mechanical coupling member having a first end connected to said mechanical actuator and a second end operatively connected to said retaining member; and, (d) a locking member for alternately maintaining said element in said first and second positions whereby, when said actuator is moved from said first position to said second position, said retaining member is actuated so that the moveable portion of said chair may be adjusted relative to the stationary portion, and when said actuator is moved from said second position to said first position, the moveable portion of the chair is fixed relative to the stationary portion.

12. The chair as claimed in claim 11 wherein said mechanical actuator is pivotally mounted to a housing in said arm.

13. The chair as claimed in claim 12 further comprising a transmission element operatively engaging said mechanical actuator.

14. The chair as claimed in claim 13 wherein said transmission element includes a cam member that travels along the actuator as said actuator moves between said first position and said second position.

15. The chair as claimed in claim 11 wherein said locking member comprises an engagement member associated with said actuator for alternately maintaining said actuator in said first and second positions.

16. The chair as claimed in claim 11 wherein said transmission element travels up to ¾ inches to actuate the reconfiguration of the chair as the actuator travels from said first position to said second position.

17. The chair as claimed in claim 11 wherein said actuator comprises an actuator button which is mounted in a housing and comprises a longitudinally extending shaft member and said locking member comprises a first engagement member positioned on said shaft and a second engagement member provided in said housing for engaging said first engagement member.

18. The chair as claimed in claim 11 wherein said coupling means further comprises a flexible cable.

19. A movable chair having a base adapted for movement across the surface on which the chair is situated, a seat member, a support member extending between the base and the seat member, the chair having a movable portion and a stationary portion, the chair comprising:

(a) a mechanical actuator comprising a lever extending in a plane and a transmission element, said transmission element operatively engaging the lever to apply a force to the lever at an angle to the plane of the lever to move the lever between a first position and a second position by a force applied by the hand of a user while seated in the chair, said actuator including a locking member for alternately maintaining said lever in said first and second positions;

(b) a retaining member for retaining said movable portion of the chair in either of at least two positions providing different configurations of the chair, said retaining member having an element that is releasable to permit said moveable portion to move between said at least two positions; and, (c) a mechanical coupling member having a first end connected to said lever and a second end operatively connected to said retaining member whereby, when said lever is moved from said first position to said second position, said element is actuated so that the moveable portion of said chair may be adjusted relative to the stationary portion, and when said lever is moved from said second position to said first position, the moveable portion of the chair is fixed relative to the stationary portion.

20. The chair as claimed in claim 19 wherein said actuator further comprises and a cam member, the cam member travelling along the actuator as said actuator moves between said first position and said second position.

21. The chair as claimed in claim 19 wherein said lever has a central portion, a first arm extending outwardly from the central portion in a first direction and operatively connected to the coupling member and a second arm extending outwardly from the central portion in a direction different to the first direction and operatively engaged by the transmission element.

22. The chair as claimed in claim 21 wherein said lever is pivotally mounted to a housing at a location between said first and second arms and said transmission element is a separate member to said lever.

23. The chair as claimed in claim 19 wherein said locking member comprises an engagement member associated with said actuator for alternately maintaining said actuator in said first and second positions.

24. The chair as claimed in claim 19 wherein said transmission element travels up to ¾ inches to actuate the reconfiguration of the chair as the lever travels from said first position to said second position.

25. The chair as claimed in claim 19 wherein said coupling means further comprises a flexible cable.

26. The chair as claimed in claim 19 wherein said actuator is positioned proximate a surface of the chair.

* * * * *